US009316396B2

(12) United States Patent
DiCintio et al.

(10) Patent No.: US 9,316,396 B2
(45) Date of Patent: Apr. 19, 2016

(54) HOT GAS PATH DUCT FOR A COMBUSTOR OF A GAS TURBINE

(71) Applicant: General Electric Company, Schenectady, NY (US)

(72) Inventors: Richard Martin DiCintio, Simpsonville, SC (US); Wei Chen, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 535 days.

(21) Appl. No.: 13/845,439

(22) Filed: Mar. 18, 2013

(65) Prior Publication Data

US 2014/0260279 A1 Sep. 18, 2014

(51) Int. Cl.

| | |
|---|---|
| ***F02C 1/00*** | (2006.01) |
| ***F23R 3/00*** | (2006.01) |
| ***F23R 3/06*** | (2006.01) |
| ***F23R 3/46*** | (2006.01) |
| *F23R 3/34* | (2006.01) |
| *F01D 9/02* | (2006.01) |

(52) U.S. Cl.

CPC . *F23R 3/005* (2013.01); *F23R 3/06* (2013.01); *F23R 3/46* (2013.01); *F01D 9/023* (2013.01); *F23R 3/346* (2013.01)

(58) Field of Classification Search

CPC ..... F23R 3/346; F23R 3/34; F23R 3/286; F23R 3/26; F01D 9/023

See application file for complete search history.

(56) References Cited

U.S. PATENT DOCUMENTS

| | | | | | |
|---|---|---|---|---|---|
| 3,872,664 | A | * | 3/1975 | Lohmann | F23R 3/14 431/9 |
| 4,265,615 | A | * | 5/1981 | Lohmann | F23R 3/346 431/158 |
| 4,420,929 | A | * | 12/1983 | Jorgensen | B60C 9/08 60/733 |
| 5,069,029 | A | * | 12/1991 | Kuroda | F23R 3/346 60/733 |
| 5,380,154 | A | | 1/1995 | Norton | |
| 5,450,725 | A | | 9/1995 | Takahara | |
| 5,475,979 | A | * | 12/1995 | Oag | F23C 6/047 60/737 |
| 5,802,854 | A | | 9/1998 | Maeda | |

(Continued)

FOREIGN PATENT DOCUMENTS

| | | | |
|---|---|---|---|
| EP | 0526058 | A1 | 3/1993 |
| EP | 0578461 | A1 | 12/1994 |
| EP | 1884297 | A1 | 2/2008 |

OTHER PUBLICATIONS

Co-Pending U.S. Appl. No. 13/845,365, dated Mar. 18, 2013.

(Continued)

*Primary Examiner* — Gerald L Sung

(74) *Attorney, Agent, or Firm* — Dority & Manning, PA

(57) ABSTRACT

A hot gas path duct or unibody liner for a gas turbine includes a main body having a forward end and an aft end. The main body defines a cross-sectional flow area and an axial flow length that extends between the forward end and the aft end. The main body further defines a fuel injection portion disposed downstream from the forward end and upstream from the aft end. The cross-sectional flow area decreases along the axial flow length between the forward end and the fuel injection portion and increases along at least a portion of the axial flow length downstream from the fuel injection portion.

15 Claims, 7 Drawing Sheets

(56) References Cited

U.S. PATENT DOCUMENTS

| | | | | |
|---|---|---|---|---|
| 6,047,550 | A | 4/2000 | Beebe | |
| 6,148,604 | A * | 11/2000 | Salt | F01D 9/023 60/39.37 |
| 6,212,870 | B1 | 4/2001 | Thompson et al. | |
| 6,374,594 | B1 | 4/2002 | Kraft et al. | |
| 6,442,946 | B1 | 9/2002 | Kraft | |
| 6,450,762 | B1 | 9/2002 | Munshi | |
| 6,543,993 | B2 | 4/2003 | Burdgick et al. | |
| 6,654,710 | B1 | 11/2003 | Keller | |
| 6,875,009 | B2 | 4/2005 | Kayahara et al. | |
| 6,896,509 | B2 | 5/2005 | Carroni et al. | |
| 6,957,949 | B2 | 10/2005 | Hyde et al. | |
| 7,082,766 | B1 | 8/2006 | Widener et al. | |
| 7,743,612 | B2 | 6/2010 | Morenko | |
| 8,096,131 | B2 | 1/2012 | Ziaei | |
| 8,158,428 | B1 | 4/2012 | Krishna | |
| 8,171,738 | B2 | 5/2012 | Fish et al. | |
| 2002/0184893 | A1 | 12/2002 | Farmer | |
| 2003/0039542 | A1 | 2/2003 | Cromer | |
| 2005/0044855 | A1 | 3/2005 | Crawley | |
| 2005/0241317 | A1 | 11/2005 | Martling | |
| 2005/0268617 | A1 | 12/2005 | Amond | |
| 2008/0282667 | A1 | 11/2008 | Intile | |
| 2009/0071157 | A1 * | 3/2009 | Cai | F23R 3/346 60/737 |
| 2009/0199561 | A1 * | 8/2009 | Hessler | F23D 11/24 60/734 |
| 2010/0054928 | A1 | 3/2010 | Schiavo | |
| 2010/0071377 | A1 | 3/2010 | Fox | |
| 2010/0139283 | A1 | 6/2010 | Phillips et al. | |
| 2010/0170216 | A1 | 7/2010 | Venkataraman | |
| 2010/0174466 | A1 | 7/2010 | Davis, Jr. et al. | |
| 2010/0263386 | A1 | 10/2010 | Edwards | |
| 2011/0067402 | A1 | 3/2011 | Wiebe | |
| 2011/0146284 | A1 | 6/2011 | Morimoto | |
| 2011/0247314 | A1 | 10/2011 | Chila | |
| 2011/0304104 | A1 | 12/2011 | McMahan | |
| 2012/0186260 | A1 | 7/2012 | DiCintio et al. | |
| 2012/0210729 | A1 | 8/2012 | Cihlar et al. | |
| 2012/0304648 | A1 | 12/2012 | Byrne | |
| 2014/0033728 | A1 * | 2/2014 | Marmilic | F02C 7/141 60/772 |
| 2014/0260272 | A1 | 9/2014 | DiCintio | |

OTHER PUBLICATIONS

Co-Pending U.S. Appl. No. 13/845,485, dated Mar. 18, 2013.
Co-Pending U.S. Appl. No. 13/845,565, dated Mar. 18, 2013.
Co-Pending U.S. Appl. No. 13/845,617, dated Mar. 18, 2013.
Co-Pending U.S. Appl. No. 13/845,661, dated Mar. 18, 2013.
Co-Pending U.S. Appl. No. 13/845,699, dated Mar. 18, 2013.
Co-Pending U.S. Appl. No. 13/845,384, dated Mar. 18, 2013.
Co-Pending U.S. Appl. No. 13/845,378, dated Mar. 18, 2013.

* cited by examiner

HOT GAS PATH DUCT FOR A COMBUSTOR OF A GAS TURBINE

FIELD OF THE INVENTION

The present invention generally involves a hot gas duct for a combustor of a gas turbine. More specifically, the invention relates to a unibody liner for the combustor.

BACKGROUND OF THE INVENTION

A combustion portion of a can annular gas turbine generally includes a plurality of combustors that are arranged in an annular array around a compressor discharge casing. Pressurized air flows from a compressor to the compressor discharge casing and is routed to each combustor. Fuel is mixed with the pressurized air in each combustor to form a combustible mixture within a primary combustion zone of the combustor. The combustible mixture is burned to produce hot combustion gases having a high pressure and high velocity. The combustion gases are routed towards an inlet of a turbine of the gas turbine through a hot gas path that is at least partially defined by one or more hot gas path ducts such as a combustion liner and/or a transition duct. Thermal and kinetic energy is transferred from the combustion gases to the turbine to cause the turbine to rotate, thereby producing mechanical work. For example, the turbine may be coupled to a shaft that drives a generator to produce electricity.

The hot combustion gases flowing through the ducts) subjects those components to high temperatures and thermal stresses. Hot spots or areas of high thermal stress have been shown to develop within certain areas of the duct due in part to separation of the combustion gases from an inner or hot side surface of the duct. There are certain respective cross sectional flow areas of a duct between a forward or inlet end and an aft or outlet end of the duct. Typically, the cross sectional flow area of the duct will converge or decrease continuously between the forward end and the aft end. Traditionally, this was done to prevent separation between the hot combustion gases and the inner surface of the duct, thereby reducing the thermal stresses within the duct.

Although this design is generally effective for reducing hot spots within a hot gas path duct of a combustor having a single combustion zone, it is less effective for a combustor that includes a secondary combustion zone that is downstream from the primary combustion zone such as a combustor that incorporates late lean fuel injection technology. In particular, a combustor that incorporates late lean fuel injection technology requires additional pressurized air to be injected in to the hot gas path downstream from the primary combustion zone to support combustion in the secondary combustion zone. Injection of the pressurized air results in increased mass flow within the duct at and downstream from the injection point which results in increased velocity of the combustion gases, thereby resulting in increased heat transfer coefficients on the inner or hot side of the duct. Therefore, an improved hot gas path duct or liner for routing the hot combustion gases from the combustor to the inlet of the turbine that incorporates late lean fuel injection would be useful.

BRIEF DESCRIPTION OF THE INVENTION

Aspects and advantages of the invention are set forth below in the following description, or may be obvious from the description, or may be learned through practice of the invention.

One embodiment of the present invention is a unibody liner for a gas turbine includes a main body having a forward end and an aft end. The main body defines a cross-sectional flow area and an axial flow length that extends between the forward end and the aft end. The main body further defines a fuel injection portion disposed downstream from the forward end and upstream from the aft end. The cross-sectional flow area decreases along the axial flow length between the forward end and the fuel injection portion and increases along at least a portion of the axial flow length downstream from the fuel injection portion.

Another embodiment of the present invention is a combustor for a gas turbine. The combustor generally includes an end cover coupled to an outer casing, a fuel nozzle that extends downstream from the end cover, a cap assembly that at least partially surrounds the fuel nozzle and a unibody liner that extends downstream from the cap assembly. The unibody liner includes a main body having a forward end and an aft end. The main body defines a cross-sectional flow area and an axial flow length that is defined between the forward end and the aft end. The main body further defines a fuel injection portion disposed downstream from the forward end and upstream from the aft end. The cross-sectional flow area decreases along the axial flow length between the forward end and the fuel injection portion and increases along at least a portion of the axial flow length downstream from the fuel injection portion.

The present invention may also include a gas turbine. The gas turbine generally includes a compressor, a combustor downstream from the compressor and a turbine having an inlet disposed downstream from the combustor. The combustor generally includes an end cover, a fuel nozzle that extends downstream from the end cover and a unibody liner that defines a flow path between the combustor and the inlet of the turbine. The unibody liner comprises a main body having an upstream end and a downstream end and defines a cross-sectional flow area. An axial flow length extends between the upstream end and the downstream end along an axial centerline of the unibody liner. A conical portion extends downstream from the forward end, a fuel injection portion extends downstream from the conical portion and a transitional portion extends downstream from the fuel injection portion. The cross-sectional flow area decreases along the axial flow length from the upstream end to the fuel injection portion and increases along at least a portion of the axial flow length downstream from the fuel injection portion.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
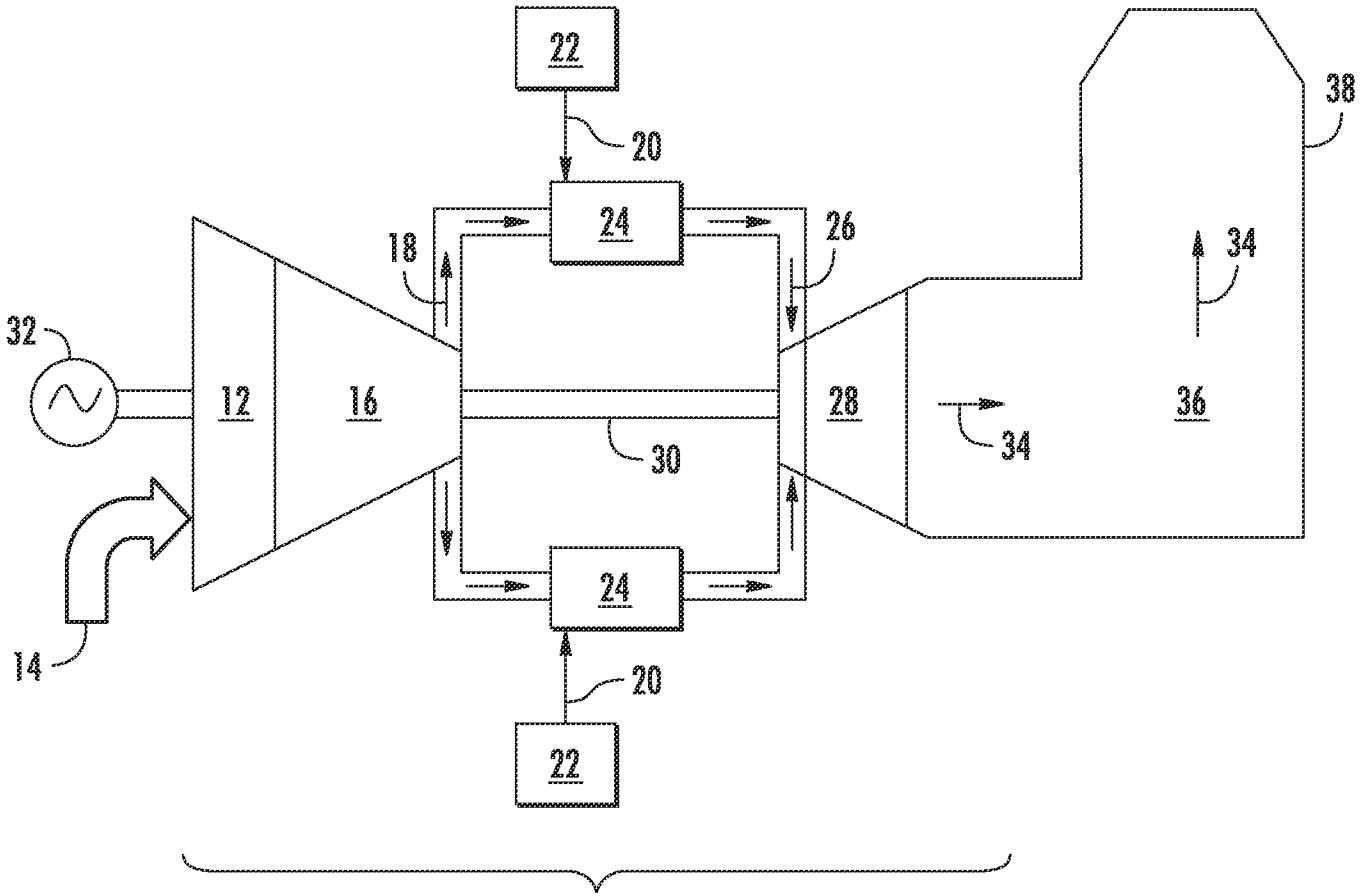
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply 22 to form a combustible mixture within one or more combustors 24. The combustible mixture is burned to produce combustion gases 26 having a high temperature and pressure. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
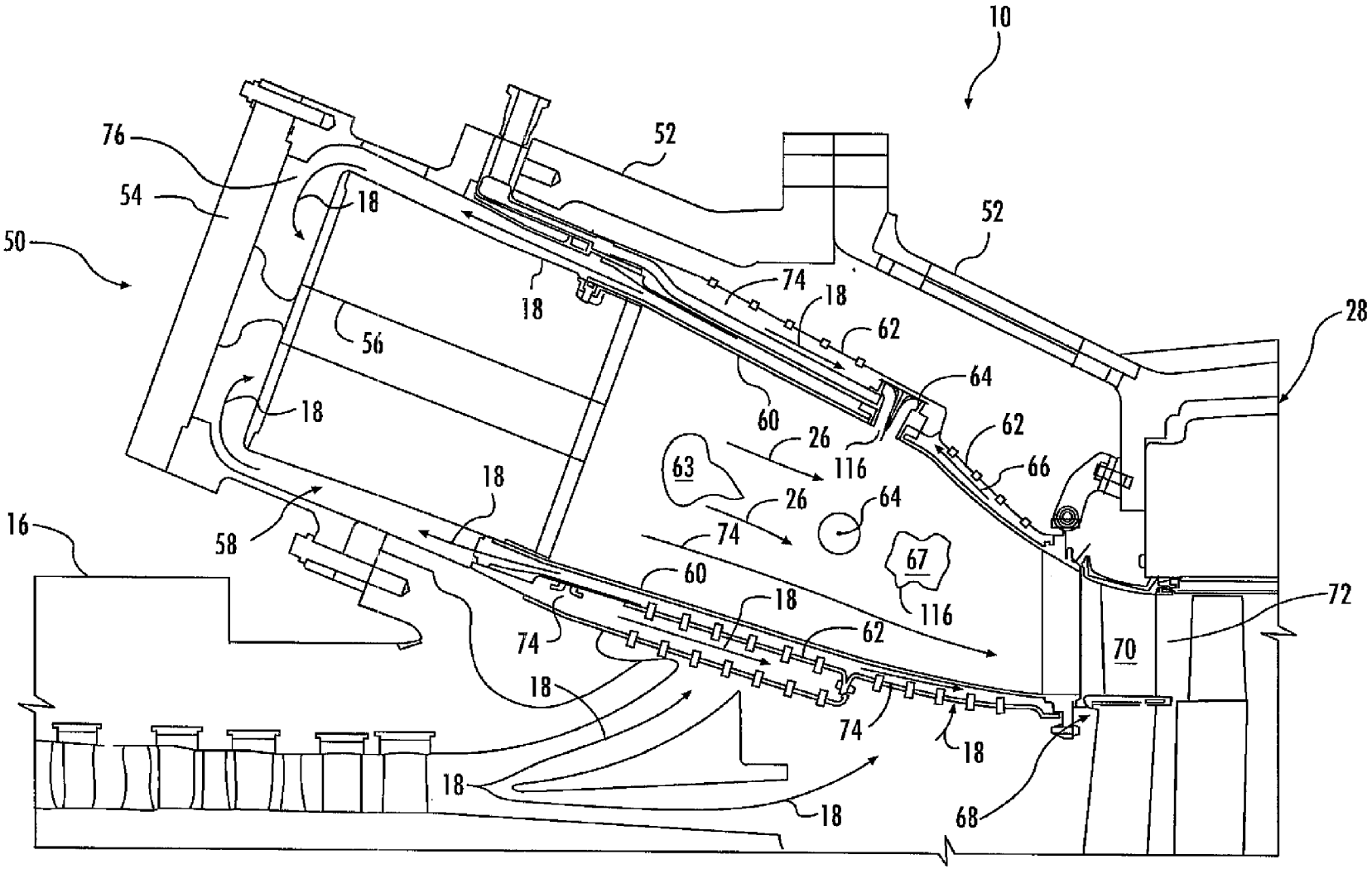
FIG. 2 is a cross-section side view of a portion of an exemplary gas turbine having an exemplary combustor according to various embodiments of the present invention.

FIG. 2 provides a cross sectional side view of a portion of an exemplary gas turbine 10 including an exemplary combustor 50 that may encompass various embodiments of the present disclosure. As shown, the combustor 50 is at least partially surrounded by an outer casing 52 such as a compressor discharge casing and/or a turbine casing. The outer casing 52 is in fluid communication with the compressor 16. An end cover 54 is coupled to the casing 52 at one end of the combustor 50. The combustor 50 generally includes at least one axially extending fuel nozzle 56 that extends downstream from the end cover 54 and an annular cap assembly 58 that extends radially and axially within the outer casing 52 downstream from the end cover 54.

In particular embodiments, a hot gas path duct or unibody liner 60, herein referred to as the "unibody 60", extends downstream from the cap assembly 58. One or more annular sleeves 62 that at least partially surround at least a portion of the unibody 60. In particular embodiments, the combustor further includes one or more radially extending fuel injectors 64 that extend through the unibody 60 downstream from the at least one axially extending fuel nozzle 56. In particular embodiments, the axially extending fuel nozzles 56 extend at least partially through the cap assembly 58 to provide a combustible mixture of the fuel 20 (FIG. 1) and the compressed working fluid 18 to a primary combustion zone 63 that is downstream from the fuel nozzle 56.

In particular embodiments, the one or more annular sleeves 62 may define one or more fluid flow passage(s) 66 for routing the compressed working fluid 18 across an outer surface of the unibody 60. In addition, the sleeve(s) 62 may route at least a portion of the compressed working fluid 18 to the one or more radially extending fuel injectors 64 to combine with fuel for combustion in a secondary combustion zone 67 that is downstream from the primary combustion zone 72. The unibody 60 generally terminates at a point that is adjacent to a first stage 68 of stationary nozzles 70. The first stage 68 of the stationary nozzles 70 at least partially defines an inlet 72 to the turbine 28. The unibody 60 at least partially defines a hot gas path 74 for routing the combustion gases 26 from the primary combustion zone 63 and the secondary combustion zone 67 to the inlet 72 of the turbine 28 during operation of the gas turbine 10.

In operation, the compressed working fluid 18 flows from the compressor 16 and is routed through the fluid flow passage(s) 66. A portion of the compressed working fluid 18 is routed to a head end 76 of the combustor 50 where it reverses direction and is directed through the axially extending fuel nozzle(s) 56. The compressed working fluid 18 is mixed with fuel to form a first combustible mixture that is injected into the primary combustion zone 63. The first combustible mixture is burned to produce the combustion gases 26. A second portion of the compressed working fluid 18 may be routed through the radially extending fuel injectors 64 where it is mixed with fuel to form a second combustible mixture. The second combustible mixture is injected through the unibody 60 and into the hot gas path 74. The second combustible mixture at least partially mixes with the combustion gases 26 and is burned in the secondary combustion zone 67. In the alternative, the compressed working fluid 18 may be fed into the hot gas path 74 through the liner 60 without adding additional fuel.

Figure 3:
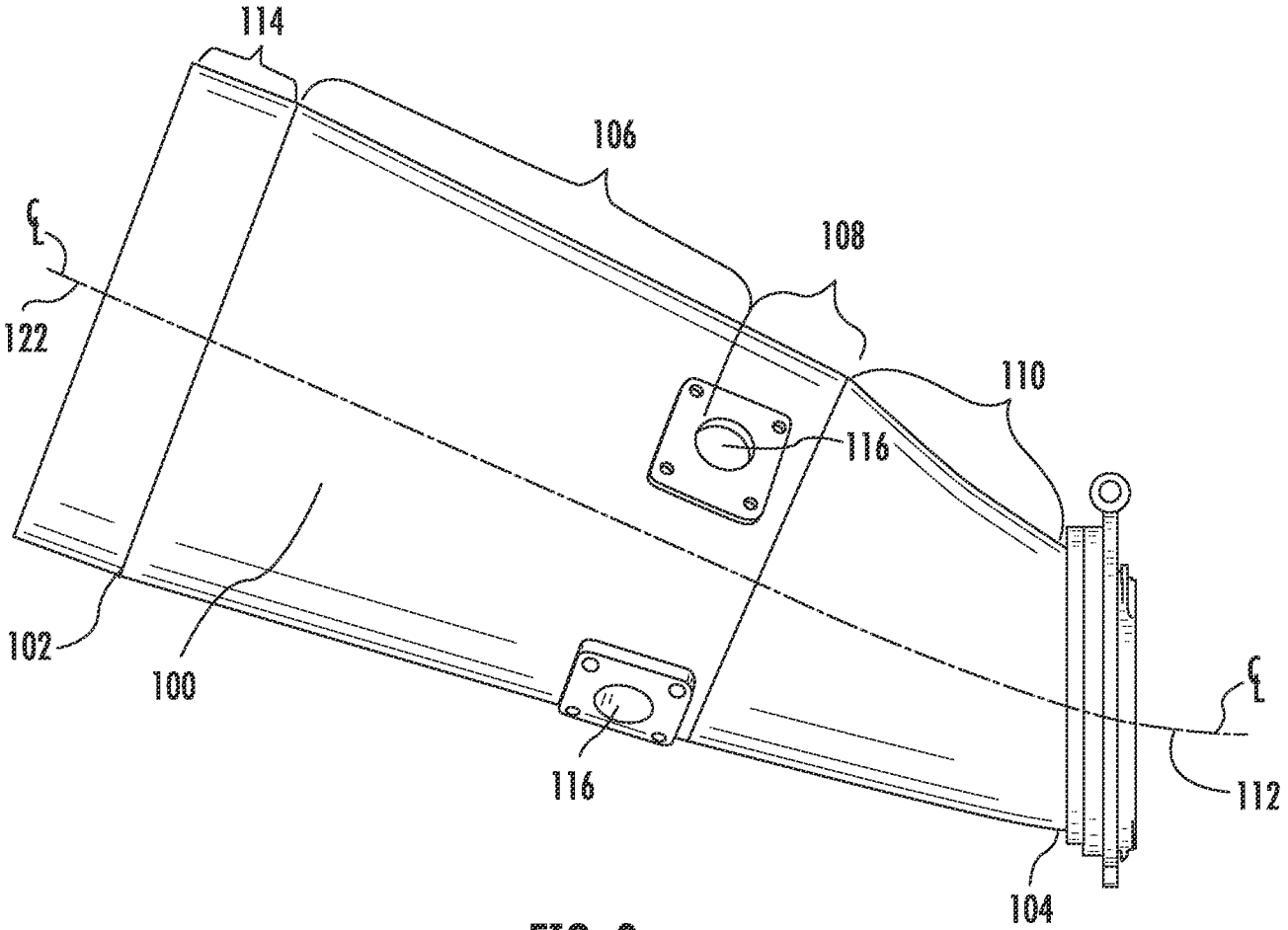
FIG. 3 is a side view of an unibody liner as may incorporate at least one embodiment of the present disclosure.
Figure 4:
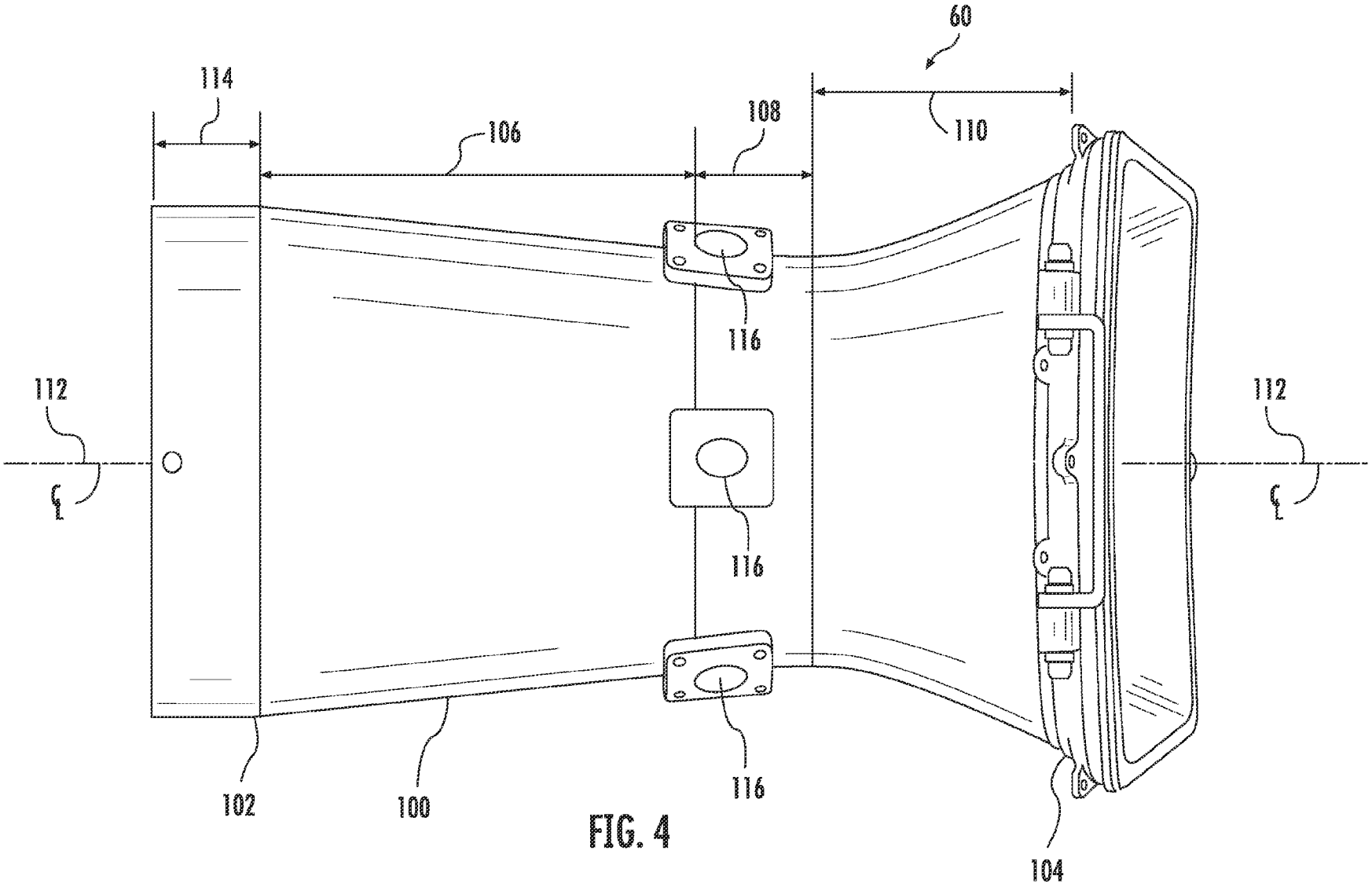
FIG. 4 is a top view of the unibody liner as shown in FIG. 3.

FIG. 3 provides a side view of the unibody 60 as shown in FIG. 2, according to at least one embodiment of the present disclosure. FIG. 4 provides a top view of the unibody liner as shown in FIG. 3. As shown in FIGS. 3 and 4, the unibody 60 generally includes a main body 100 having a generally annular shape. The main body 100 includes a forward end 102, an aft end 104, a generally conical portion 106, a fuel injection portion 108 and a transition portion 110. The conical portion 106 extends between the forward end 102 and the fuel injection portion 108, and the transition portion 110 extends downstream from the fuel injection portion 108 and terminates generally adjacent to the aft end 104. The fuel injection portion 108 generally extends across the secondary combustion zone 67 (FIG. 2). The unibody 60 may be generally cast as a singular component or may be formed from individual components which are connected so as to form a continuous hot gas path.

The conical portion 106 generally has a substantially circular cross section with respect to a plane that is perpendicular to an axial centerline 112 of the main body 100. The fuel injection portion 108 may have a substantially circular cross section and/or a substantially non-circular cross section with respect to a plane that is perpendicular to the axial centerline 112. As shown in FIG. 4, the transition portion 110 may have a substantially non-circular cross section with respect to a plane that is perpendicular to the axial centerline 114. In alternate embodiments, as shown in FIGS. 3 and 4, the main body 100 may further include a support portion 114 that extends upstream from the forward end 102.

In particular embodiments, the main body 100 at least partially defines one or more fuel injector openings 116 disposed downstream from the forward end 102 and upstream from the aft end 104. The fuel injector openings 116 are disposed within the fuel injection portion 108 of the main body 100. The fuel injector openings 116 provide for fluid communication through the main body 100 and into the hot gas path 74 (FIG. 2). In particular embodiments, as shown in FIG. 2, each of the fuel injectors 64 extends at least partially through a corresponding fuel injector opening 116.

Figure 5:
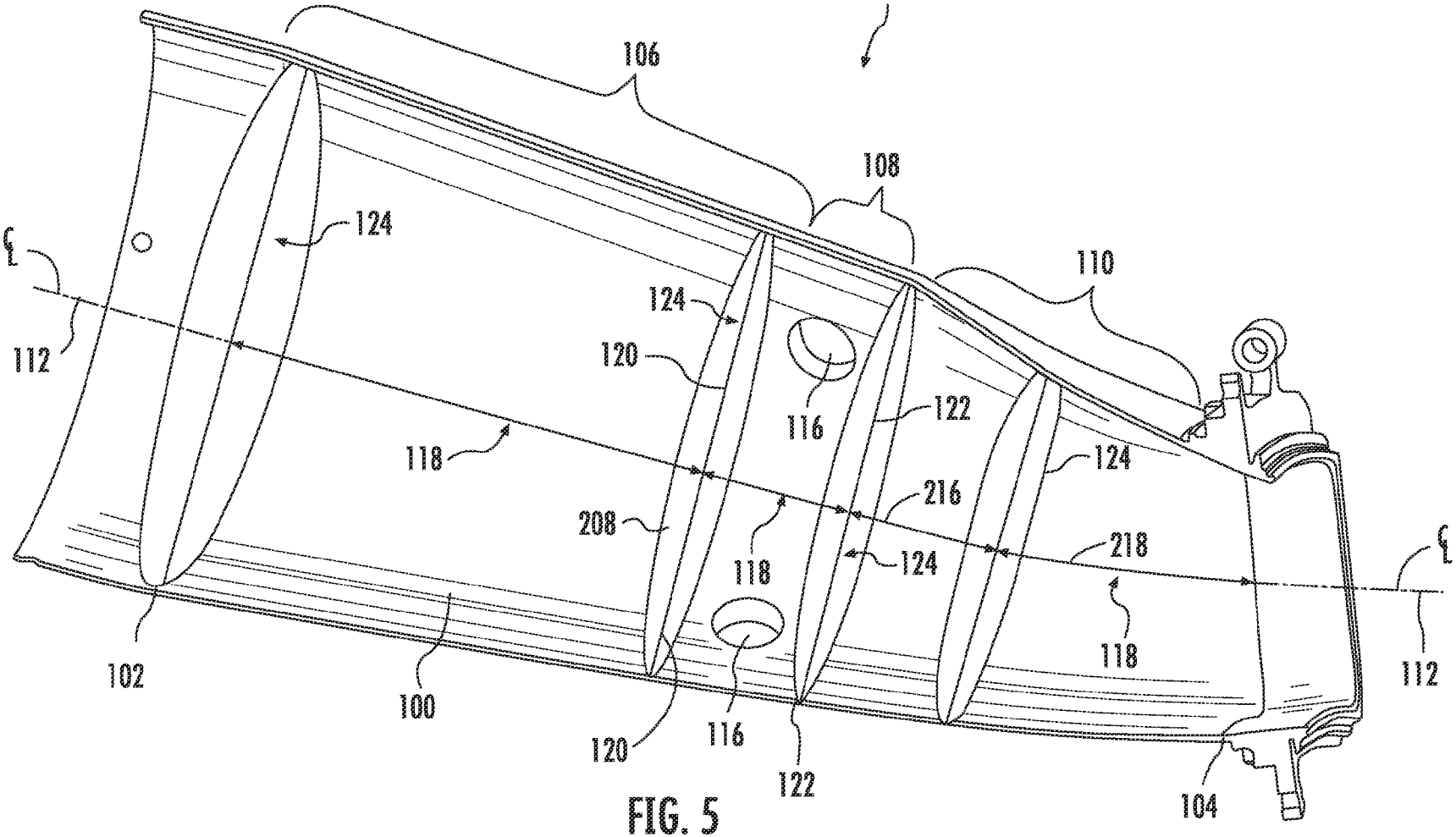
FIG. 5 is a cross-section perspective view of the unibody liner as shown in FIG. 3, according to at least one embodiment of the present disclosure.

FIG. 5 provides a cross section perspective view of the unibody 60 as shown in FIG. 3, according to at least one embodiment of the present disclosure. As shown in FIG. 5, an axial flow length 118 is defined along the axial centerline 112. The axial flow length 118 extends through the main body 100 between the forward end 102 and the aft end 104. In particular embodiments, the fuel injection openings 116 generally define an intersection point 120 along the axial flow length 118 where the conical portion 106 and the fuel injection portion 108 intersect. The intersection point 120 may be defined adjacent to or upstream from the fuel injection openings 116. Another intersection point 122 is generally defined along the axial flow length 118 where the fuel injection portion 108 and the transition portion 110 intersect. This intersection point 122 is generally defined at a position along the axial flow length 118 where the main body 100 transitions from a substantially circular cross section to a substantially non-circular cross section downstream from the fuel injector openings 116.

The intersection points 120 and 122 are generally defined within a plane that is substantially perpendicular to the axial centerline 112. The intersection points 120 and 122 may shift upstream or downstream from the shown positions shown in FIGS. 3, 4 and 5 depending on such factors as the diameter of the unibody 60, a desired or required mass flow rate through the unibody 60, operating temperatures within the unibody 60, thermal profile of the unibody 60 and/or positioning of the fuel injector openings 116.

As shown in FIG. 5, the main body 100 defines a cross-sectional flow area 124. The cross sectional flow area 124 is generally defined with respect to a plane that extends perpendicular to the axial centerline 112. The cross-sectional flow area 124 may increase, decrease, or remain constant along any portion of the axial flow length 118. The size of the cross-sectional flow area 124 of the unibody 60 generally affects a flow velocity of the combustion gases 26 flowing through the unibody liner 60 and/or the hot gas path 74.

Figure 6:
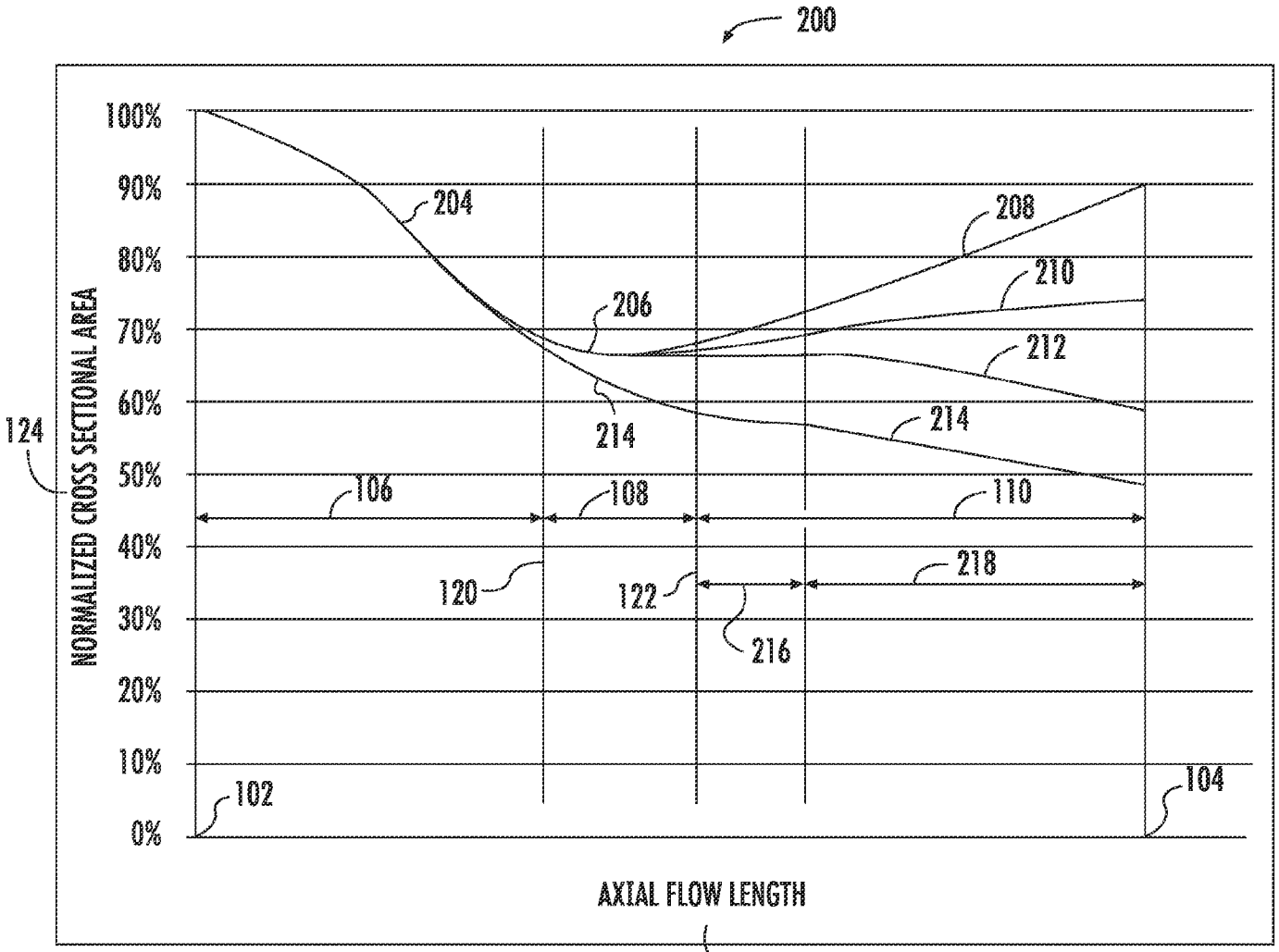
FIG. 6 is a normalized graphical illustration of cross-sectional flow area of the unibody liner with respect to axial flow length across a conical portion, a fuel injection portion and a transition portion of the unibody liner according to various embodiments of the present invention.

FIG. 6 provides a normalized graphical illustration 200 of cross-sectional flow area 124 with respect to axial flow length 118 across the conical portion 106, the fuel injection portion 108 and the transition portion 110 of the unibody 60. As illustrated by line 204, the cross-sectional flow area 124 generally decreases along the axial flow length 118 from a maximum cross-sectional flow area 124 at the forward end 102 to a smaller cross-sectional flow area 124 at the intersection point 120 between the conical portion 106 and the fuel injection portion 108 of the main body 100. It should be appreciated that line 204 also illustrates a cross-sectional area of a traditional liner (not shown).

In particular embodiments, as illustrated by line 206, the cross-sectional flow area 124 may increase, remain constant and/or may decrease along the axial flow length 118 across the fuel injection portion 108. In particular embodiments, as illustrated by lines 208, 210 and 212, the cross-sectional flow area 124 increases along at least a portion of the axial flow length 118 that is defined downstream from the intersection point 122. In contrast, as illustrated by line 214, the cross-sectional flow area of the traditional liner continues to decrease through the fuel injection portion 108 and the transition portion 110.

In one embodiment, as illustrated by line 208, the cross-sectional flow area 124 increases continuously downstream from the intersection point 122 between the fuel injection portion and the aft end 104. In another embodiment, the cross-sectional flow area 124 increases continuously along a first portion 216 of the axial flow length 118 that is defined downstream from the intersection point 122 at a first rate of increase, and then increases at a second rate of increase along a second portion 218 of the axial flow length that is defined downstream from the first portion. In another embodiment, the cross-sectional flow area 124 increases continuously along the first portion 216 of the axial flow length 118 that is defined downstream from the intersection point 122 and then decreases along the second portion 218 of the axial flow length 118 that is defined downstream from the first portion 216.

Figure 7:
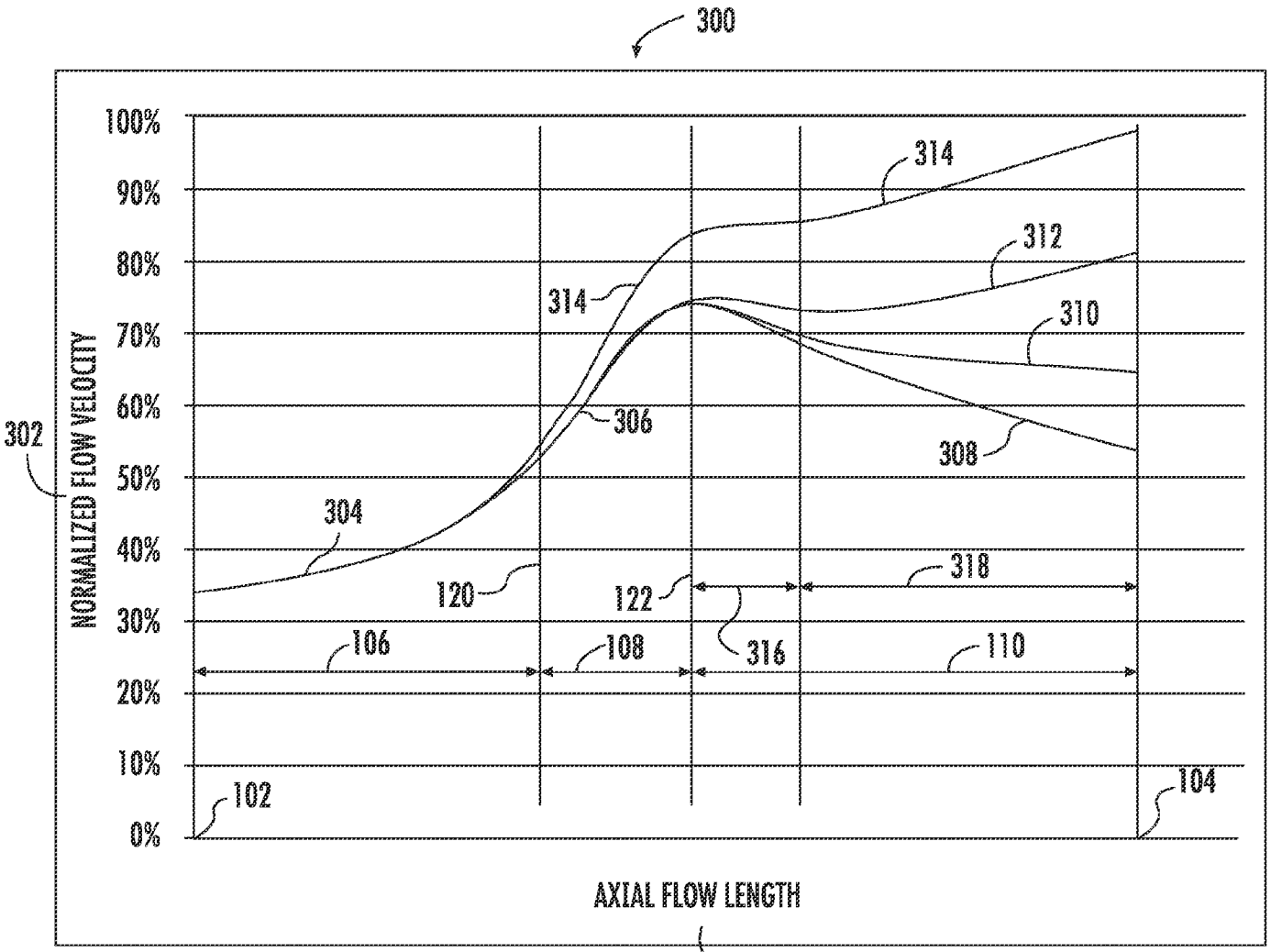
FIG. 7 is a normalized graphical illustration of flow velocity through the unibody liner with respect to axial flow length as related to the cross-sectional flow area as shown in FIG. 6, according to various embodiments of the present invention.

FIG. 7 provides a normalized graphical illustration 300 of flow velocity 302 of the combustion gases 26 (FIG. 2) through the unibody 60 including the traditional transition liner or duct with respect to axial flow length 118 through the conical portion 106, the fuel injection portion 108 and the transition portion 110 of the unibody 60 and traditional liner or duct. As shown in FIGS. 6 and 7, line 304 correlates to line 204, line 306 correlates to line 206, line 308 correlates to line 208, line 310 correlates to line 210, line 312 correlates to line 212 (FIG. 6), line 314 correlates to line 214 (FIG. 6), line 316 correlates to line 216 (FIG. 6) and line 318 correlates to line 218 (FIG. 6), line 308 correlates to line 208 (FIG. 6).

As shown in FIGS. 6 and 7, and illustrated in lines 204 and 304, the flow velocity of the combustion gases 26 (FIG. 2) increase as the cross-sectional flow area 124 decreases along the axial flow length 118 through the conical portion 106. As illustrated by lines 206, 214 and 306 and 314, the flow velocity will increase at a much higher rate along the axial flow length 118 within the fuel injection portion 108 due to additional mass flow of the second combustible mixture and/or the compressed air through the unibody 60 and into the hot gas path 74.

The increased flow velocity generally results in increased heat transfer coefficients at the transition portion which results in hot spots or areas of high thermal stress on an inner surface of the unibody 60 and/or the traditional liner or duct. In the various embodiments of the present invention, as shown in FIG. 6 by lines 208, 210, 212, an increase in the cross-sectional flow area 124 at or downstream from the fuel injection portion 108 will result in a decrease in the flow velocity 302 of the combustion gases 26 (FIG. 2) as shown in FIG. 7 by lines 310, 312 and 314. By maintaining or reducing the flow velocity 302 through the unibody 60 at or downstream from the fuel injection portion 108, heat transfer coefficients are significantly reduced, thereby improving the durability and overall performance of the combustor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A unibody liner, comprising:

a. a main body having a forward end and an aft end, the main body defining a cross-sectional flow area and an axial flow length that is defined between the forward end and the aft end, the main body further defining a fuel injection portion disposed downstream from the forward end and upstream from the aft end; and b. wherein the cross-sectional flow area decreases along the axial flow length between the forward end and the fuel injection portion and increases along at least a portion of the axial flow length downstream from the fuel injection portion and wherein the cross-sectional flow area increases continuously along the axial flow length downstream from the fuel injection portion to the aft end.

2. The unibody liner as in claim 1, wherein the cross-sectional flow area increases along a first portion of the axial flow length that is defined downstream from the fuel injection portion and decreases along a second portion of the axial flow length that is defined downstream from the first portion.

3. The unibody liner as in claim 1, wherein the cross-sectional flow area is substantially constant along the axial flow length across the fuel injection portion.

4. The unibody liner as in claim 1, wherein the cross-sectional flow area decreases in a downstream direction along the axial flow length across the fuel injection portion.

5. The unibody liner as in claim 1, wherein the cross-sectional flow area increases in a downstream direction along the axial flow length across the fuel injection portion.

6. The unibody liner as in claim 1, further comprising a conical portion that extends between the forward end and the fuel injection portion and a transitional portion that extends downstream from the fuel injection portion and terminates at the aft end.

7. A combustor for a gas turbine, comprising:

a. an end cover coupled to an outer casing;

b. a fuel nozzle that extends downstream from the end cover;

c. a cap assembly that at least partially surrounds the fuel nozzle; and d. a unibody liner that extends downstream from the cap assembly, the unibody liner comprising:

i. a main body having a forward end and an aft end, the main body defining a cross-sectional flow area and an axial flow length that is defined between the forward end and the aft end, the main body further defining a fuel injection portion disposed downstream from the forward end and upstream from the aft end; and ii. wherein the cross-sectional flow area decreases along the axial flow length between the forward end and the fuel injection portion and increases along at least a portion of the axial flow length downstream from the fuel injection portion and wherein the cross-sectional flow area increases continuously along the axial flow length downstream from the fuel injection portion to the aft end.

8. The combustor as in claim 7, wherein the cross-sectional flow area is substantially constant along the axial flow length across the fuel injection portion.

9. The combustor as in claim 7, wherein the cross-sectional flow area decreases in a downstream direction along the axial flow length across the fuel injection portion.

10. The combustor as in claim 7, wherein the cross-sectional flow area increases in a downstream direction along the axial flow length across the fuel injection portion.

11. The combustor as in claim 7, wherein the unibody liner further comprises a conical portion that extends between the forward end and the fuel injection portion and a transitional portion that extends downstream from the fuel injection portion and terminates at the aft end.

12. A gas turbine comprising:

a. a compressor;

b. a combustor downstream from the compressor;

c. a turbine having an inlet disposed downstream from the combustor; and d. wherein the combustor includes an end cover, a fuel nozzle that extends downstream from the end cover and a unibody liner that defines a flow path between the combustor and the inlet of the turbine, the unibody liner comprising:

i. a main body having an upstream end and a downstream end, the main body defining a cross-sectional flow area;

ii. an axial flow length that extends between the upstream end and the downstream end along an axial centerline of the unibody liner;

iii. a conical portion that extends downstream from the forward end, a fuel injection portion that extends downstream from the conical portion and a transitional portion that extends downstream from the fuel injection portion; and iv. wherein the cross-sectional flow area decreases along the axial flow length from the upstream end to the fuel injection portion and increases along at least a portion of the axial flow length downstream from the fuel injection portion and wherein the cross-sectional flow area increases continuously along the axial flow length between the fuel injection portion and the downstream end of the main body.

13. The gas turbine as in claim 12, wherein the fuel injection portion has a substantially constant cross-sectional flow area along the axial flow length.

14. The gas turbine as in claim 12, wherein the fuel injection portion has a decreasing cross-sectional flow area.

15. The gas turbine as in claim 12, wherein the fuel injection portion has an increasing cross-sectional flow area.

* * * * *